United States Patent [19]

Justice, Sr. et al.

[11] Patent Number: 4,972,618

[45] Date of Patent: Nov. 27, 1990

[54] REVOLVER SAFETY LOCK APPARATUS

[76] Inventors: Jerry P. Justice, Sr., 2164 Warwick, Houston, Tex. 77093; Arthur H. Woolery, Sr., 1210 Wardmont, Houston, Tex. 77037

[21] Appl. No.: 482,652

[22] Filed: Feb. 21, 1990

[51] Int. Cl.[5] ..... F41A 17/74

[52] U.S. Cl. ..... 42/70.110; 42/66

[58] Field of Search ..... 42/70.11, 66

[56] References Cited

U.S. PATENT DOCUMENTS

| | | |
|---|---|---|
| 565,678 | 8/1896 | Foster . |
| 1,227,531 | 5/1917 | Donadio . |
| 2,945,316 | 7/1960 | Mulno . |
| 2,994,981 | 8/1961 | Carrigan . |
| 3,462,869 | 8/1969 | Wallace . |
| 3,553,877 | 1/1971 | Welch et al. . |
| 4,136,475 | 1/1979 | Centille . |
| 4,894,939 | 1/1990 | Perry . |

*Primary Examiner*—Charles T. Jordan
*Assistant Examiner*—Richard W. Wendtland
*Attorney, Agent, or Firm*—Pravel, Gambrell, Hewitt, Kimball & Krieger

[57] ABSTRACT

A locking mechanism for a revolver that completely disables the weapon when in the locked position. The mechanism includes a set screw that is inserted in a small hole drilled in the side of the revolver side plate behind the trigger. The set screw has attached to it a small button such that when the mechanism is in a locked position, the button located on the screw acts as a hammer block and also acts to prevent the cylinder release bar from unlocking the cylinder. When the mechanism is in an unlocked position, the weapon functions as originally intended by the manufacturer.

10 Claims, 3 Drawing Sheets

REVOLVER SAFETY LOCK APPARATUS

BACKGROUND OF THE INVENTION

1. Field of the Invention

The present invention relates generally to safety devices for firearms, and more particularly to a safety locking device for a revolver that may be incorporated into an existing weapon design or, alternatively, may be installed in a premanufactured weapon, wherein the safety locking device includes a mechanism for locking both the cylinder release and the hammer to prevent the hammer from moving into a cocked position and trigger of the revolver.

2. Description of the Prior Art

The desirability of safety mechanisms on firearms has long been recognized and their presence on semi-automatic or self-loading weapons, as well as on other types of weapons, is standard. Typically these safety devices are simple toggle mechanisms movable between safe and ready positions. In the safe position, the safety acts either to prevent the trigger from being pulled, prevent the hammer from being cocked, or prevent an already cocked hammer from moving to strike the firing pin.

Many of the known patents for safety mechanisms on firearms have utilized some type of hammer-block to safety the revolver. For example, U.S. Pat. No. 2,994,981 discloses a pivotable hammer blocking rod which may be brought into selective contact with the hammer when a locking tumbler mounted within the handle of the weapon is turned.

Many of the safety mechanisms that have been designed for revolvers are deficient in that they do not prevent the unauthorized use of the firearm, but merely prevent an accidental discharge of the firearm when the safeties are activated. Due to the increasing number of gun-related accidents and deaths occurring nationally, especially those occurring among children, it is desirable that a safety mechanism for a firearm include a locking capability such that the safety mechanism cannot be readily disabled without an external device such as a key. For example, U.S. Pat. No. 2,945,316 discloses a hammer blocking safety for a firearm which is operable by a specially designed key. A spring loaded rod having a hammer block at one end is retained within the revolver handle frame. U.S. Pat. No. 3,462,869 discloses a key operated safety lock device for firearms wherein a lock cylinder acting as a hammer block is mounted within the frame of the revolver.

The locking devices for revolvers such as those mentioned above are relatively expensive in that they generally require major modifications to the firearm. These modifications generally alter the appearance of the firearm to a noticeable degree. Furthermore, these locking devices generally only disable the firing mechanism, but still allow the cylinder of the weapon to be opened, thus permitting loading of the weapon. Therefore, it is accordingly an object of the present invention to provide a reliable safety lock device for a firearm which is capable of disabling the entire weapon when in the locked position and furthermore can be applied to premanufactured firearms without appreciable cost and with minimal modification to the weapon. Further, the present invention may be incorporated into an existing weapon design.

SUMMARY OF THE INVENTION

The present invention includes a locking device for a revolver that acts as both a hammer block which prevents the hammer and, consequently, the trigger from operating and also acts to block the cylinder release bar to prevent the cylinder from being opened for either loading or unloading. Therefore, when the locking device is set to a locked position, the revolver is completely inoperable and virtually tamperproof. Furthermore, the installation of the present invention requires minimal modification to a premanufactured weapon.

For a premanufactured weapon, the present invention requires a small hole to be drilled in the side of the revolver side plate behind the trigger and above the grip. The hole is threaded and includes a small counterface on the inside of the side plate adapted to receive a locking pin. The locking pin is comprised of a set screw having a selected drive means, e.g., an allen drive, star drive, phillips drive, etc., and a flat cylindrical button attached to the set screw and adapted to fit flush within the counterface when fully inserted. A small radius is milled in the side of the rearward portion of the hammer of the weapon which is adapted to mate with the radius of the flat cylindrical button when the button and the hammer are brought into contact with each other.

To place the safety mechanism in a locked position, the set screw is rotated clockwise by the selected drive means to extend the button into the path of the hammer. This acts as a hammer block, thus preventing the hammer and consequently the trigger from moving into a cocked or firing position. Furthermore, the position of the locking pin is such that it prevents the cylinder release bar from operating. Thus, the cylinder cannot be opened for loading or unloading. To return the safety mechanism from the locked position to the unlocked position, the selected drive means is used to rotate the locking pin set screw counterclockwise to retract the button from the path of the hammer and from the path of the cylinder release bar.

Therefore, the safety mechanism according to the present invention virtually disables the weapon when in the locked position. When the safety mechanism is in the unlocked position, the weapon functions as originally intended by the manufacturer.

BRIEF DESCRIPTION OF THE DRAWINGS

A better understanding of the invention can be obtained when the following detailed description of the preferred embodiment is considered in conjunction with the following drawings, in which.

DETAILED DESCRIPTION OF THE PREFERRED EMBODIMENT

Figure 1:
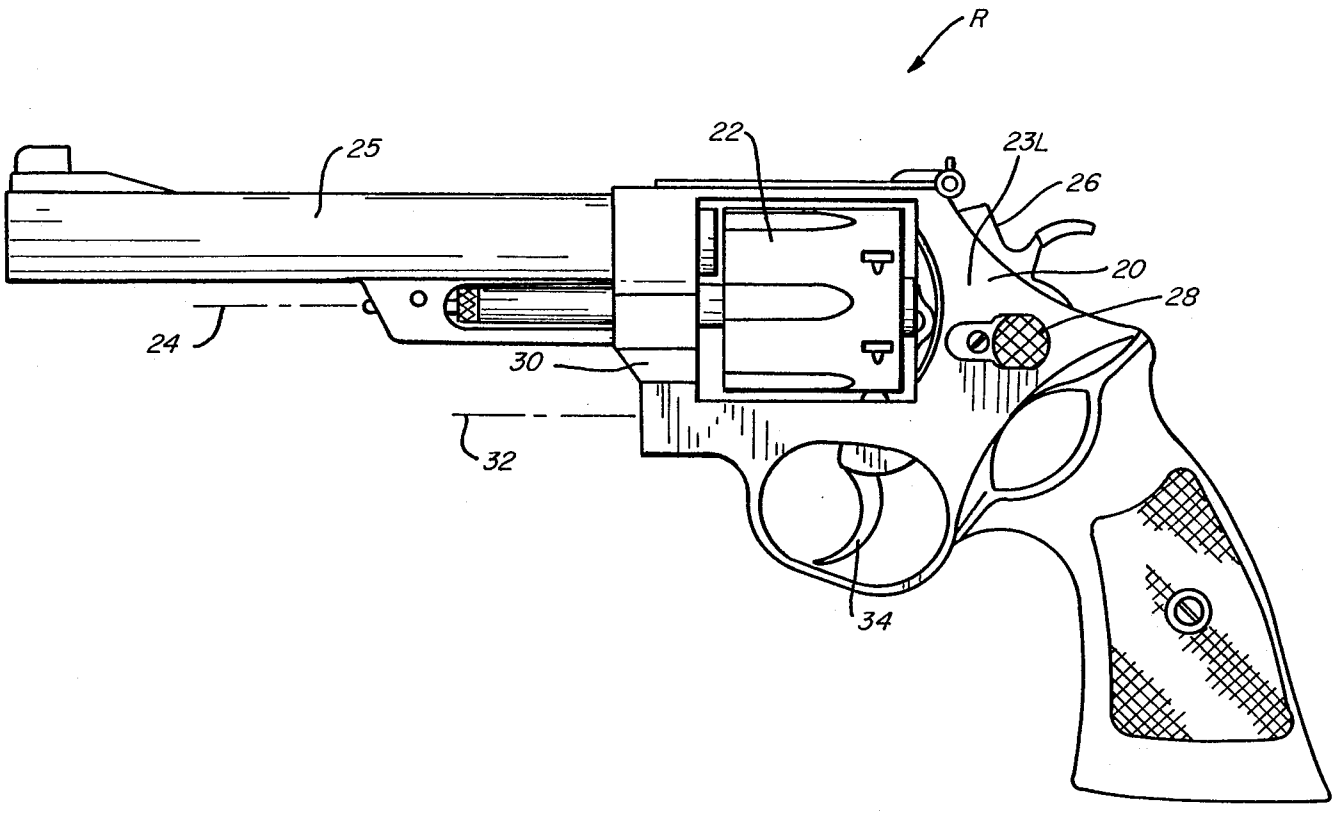
FIG. 1 is a side view of a revolver incorporating the present invention.

Referring now to FIG. 1, a revolver R is generally shown. The revolver used in the present embodiment is preferably a Smith & Wesson revolver, but the use of other types of revolvers is also contemplated. Many of the details of a revolver that are not relevant to the present invention have been omitted for the purpose of clarity. The revolver R includes a frame 20, a cartridge holding cylinder 22 rotatable about its axis 24, side plates 23L and 23R (not shown—on opposite side of revolver) a barrel 25, a pivotable cartridge striking hammer 26 spring biased within the frame 20 toward the cylinder 22 and manually pivotable to a first or cocked position against the spring bias away from the cylinder 22 (clock-wise as viewed) preparatory to striking a cartridge (not shown), and a trigger 34 for actuating the hammer 26 which moves the hammer into its second (firing) position wherein it strikes a cartridge (not shown). The cylinder 22 includes a plurality of cylinder chambers (not shown) which are used to hold cartridges. In the illustrated embodiment there are six cartridge chambers in the cylinder 22. The revolver R also includes a thumbpiece 28 movable between a first position wherein the cylinder 22 is unlatched and may be swung out by pivoting a yoke or crane 30 about its axis 32 facilitating insertion of cartridges (no shown) into the cylinder 22, and a second position (toward the right as viewed) where the cylinder 22 is in the illustrated closed position and cartridges are captive within the cylinder 22. The revolver R illustrated is a double-action type wherein the hammer 26 may be moved to its first or cocked position by thumb movement and actuated by a light pull on the trigger 34 to move the hammer 26 to its second position and strike a cartridge (not shown). Alternatively, a much heavier pull on the trigger 34 may be used to move the hammer 22 to its first or cocked position and actuate the hammer 26 to its second or firing position in one motion. The revolver R includes a cylinder stop 36 to ensure that successive cylinder chambers align properly with the barrel 25, and an internal pawl (not shown) for indexing the cylinder 22.

Figure 2B:
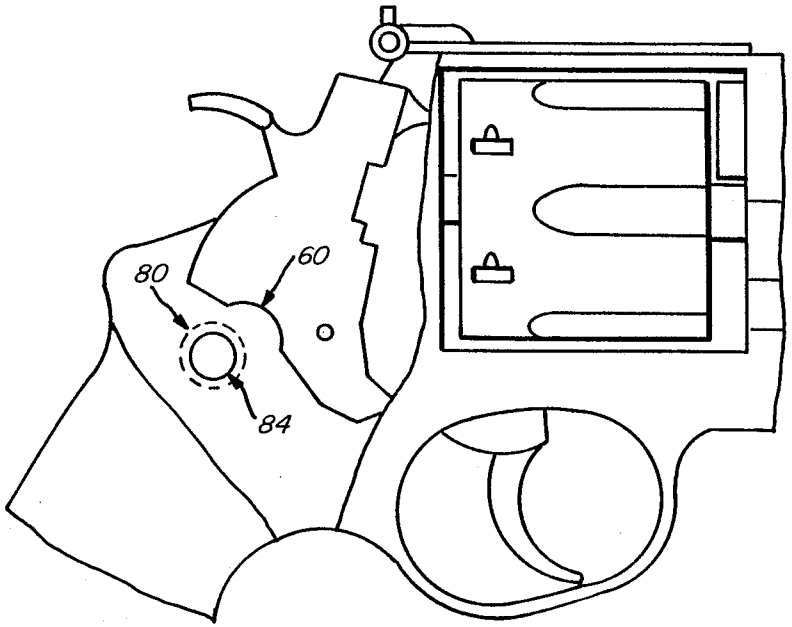
FIGS. 2A and 2B are a cut-away view of the opposite side of the revolver of FIG. 1 according to the present invention.
Figure 2A:
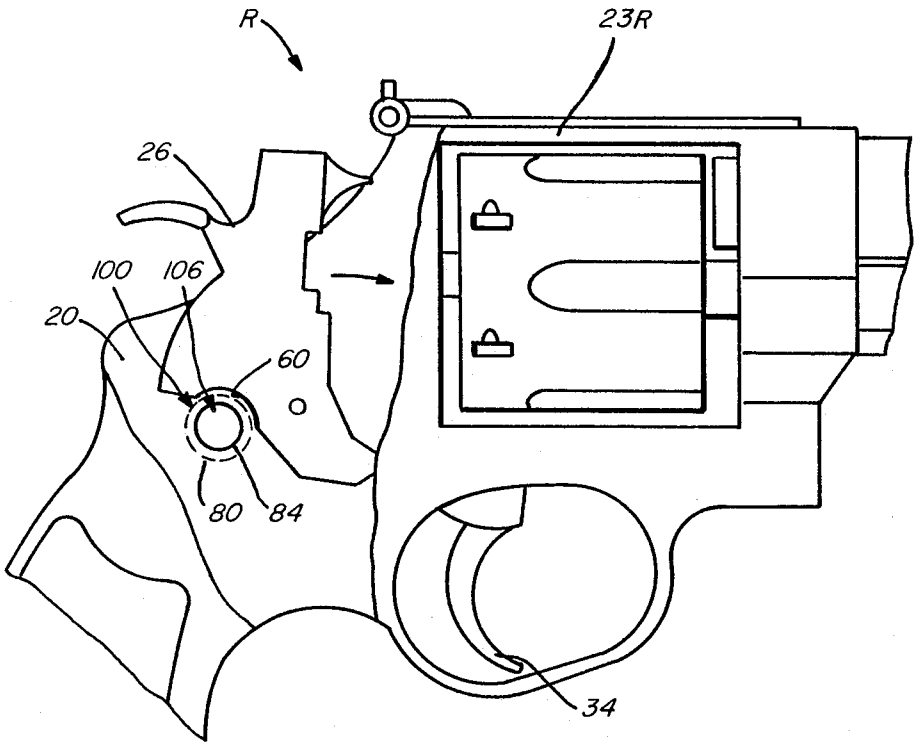

FIGS. 2A and 2B are cut-away views of the side of the revolver R opposite that shown in FIG. 1. A safety locking mechanism 100 according to the present invention is generally inserted on this side of the revolver R. The installation of the safety locking mechanism 100 requires some minor modifications to the original parts of a premanufactured weapon. First, a hammer relief radius 60 is milled in the hammer 26, and a hole 80 is drilled in the side plate 23R and/or frame 20 at a predetermined location. In one embodiment of the present invention, the hammer 26 is milled to a partial radius of preferably 0.4" in diameter and preferably 0.04" deep at the lower rear portion, and the hole is threaded 8–32 and counterbored preferably 0.4" diameter and 0.06" deep on the inside face of side plate, as shown in FIG. 2A. However, the use of other specifications to mill the hammer 26 and drill the hole 80 according to the present invention is also contemplated.

Figure 3:
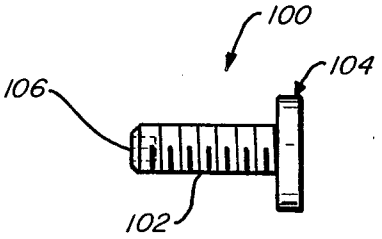
FIG. 3 is a side view of the safety locking mechanism according to the present invention.

Referring now to FIG. 3, the safety locking mechanism 100 is comprised of a set screw 102 having a thread mating with thread (not shown) in side plate 23R which can be actuated by a selected drive means that is mated with the socket 106 of the screw 102. Attached to the end of the screw 102 is a flat cylindrical button 104 that is adapted to fit flush within the counterbore 84 on the inside of side plate 23R (FIG. 2A) when fully inserted. The flat cylindrical button 104 is attached to the set screw preferably by a mechanical means such as welding. In an alternate embodiment of the present invention, the set screw 102 and the flat cylindrical button 104 are a unitary piece. Further, while the present embodiment contemplates a cylindrical button 104 co-axial with the set screw 102, it is understood that other blocking means which are non-coaxial with screw 102 may be used.

Referring again to FIG. 2A, the safety locking mechanism 100 is threaded into the hole 80 in the side plate and/or frame 20 from the inside of plate 23R and the revolver is reassembled. A selected drive means (not shown) adapted to mate with the socket 106 of the safety locking mechanism 100 is used to rotate the locking mechanism. The radius 60 that is milled in the side of the rearward portion of the hammer 26 is adapted to mate with the flat cylindrical button 104 when the hammer 26 and the flat cylindrical button 104 are brought into contact. When the safety locking mechanism 100 is installed and is turned clockwise to a "locked" position such that it can no longer be turned by the selected drive means, the flat cylindrical button 104 is extended into the path of the hammer 26 at the milled radius 60 and acts as a hammer block, thus preventing the hammer 26 and, consequently, the trigger 34 from operating.

Figure 4:
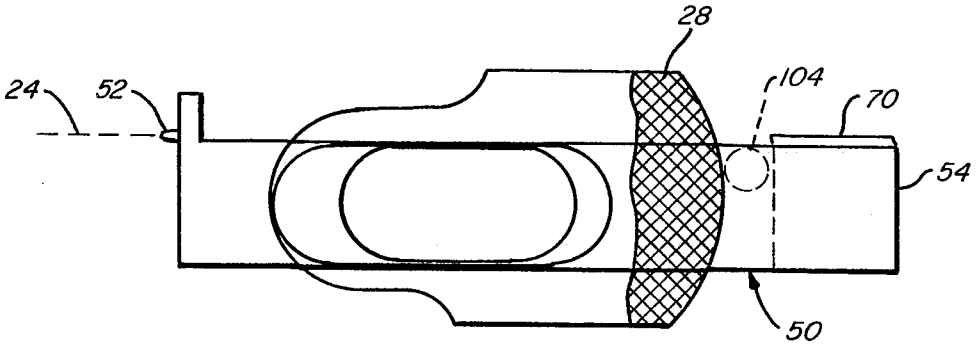
FIG. 4 is a view of the spatial relationship of the safety of the present invention and the cylinder release mechanism in the revolver of FIG. 1 according to the present invention.
Figure 5:
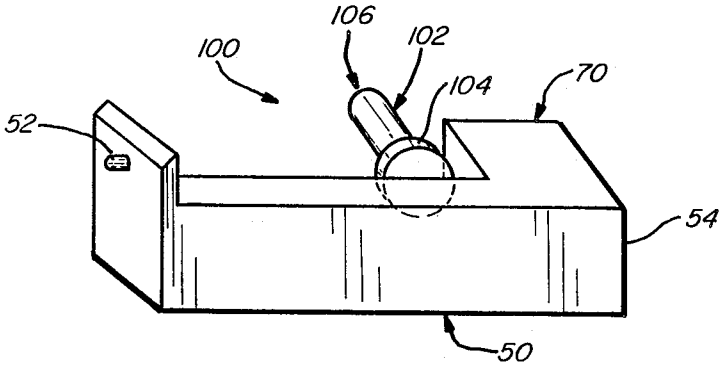
FIG. 5 is a perspective view of FIG. 4 when the safety of the present invention is activated.

Referring now to FIG. 4, within the frame 20 is a cylinder locking bolt 50 that is movable horizontally as viewed in an internal milled slot in the frame 20 (FIG. 1) under the control of the thumbpiece 28. When the thumbpiece 28 is moved toward the left, a projection 52 moves along the axis 24 forcing a cylinder latching center pin (not shown) out of engagement with the frame 20 and allowing the cylinder 22 (FIG. 1) to be swung out or pivoted about its axis 32 for loading. When the cylinder 22 is swung back or closed, the spring loaded center pin pushes the cylinder locking bolt 50 to the right normally sufficiently far that the projecting or enlarged end 54 of the cylinder locking bolt 50 clears the operating path of the hammer 26. The cylinder locking bolt 50 according to the present invention includes a tab 70 which projects inward into revolver R. As shown in FIG. 5, when the safety locking mechanism 100 is turned clockwise to the "locked" position, the flat cylindrical button 104 is extended into the path of the tab 70 of the cylinder locking bolt 50 such that the cylinder locking bolt 50 cannot be moved to the left and thus the cylinder 22 cannot be unlocked.

Therefore, when the safety locking mechanism 100 is turned clockwise to a "locked" position, the flat button 104 is extended into the paths of both the hammer 26 and the cylinder locking bolt 50, preventing the hammer 26 from being cocked and preventing the cylinder 22 from being unlocked. When the safety locking mechanism 100 is turned counterclockwise to an "unlocked" position, the flat button 104 is retracted from the paths of the hammer 26 and the cylinder locking bolt 50, and the revolver R functions as originally intended by the manufacturer. Thus, the present invention virtually disables the weapon when in the locked position. The selected drive means is required to move the safety locking mechanism between the "locked" and "unlocked" positions, thereby rendering the weapon virtually childproof in the "locked" position. Furthermore, the addition of the present invention to a premanufactured weapon requires minimal modification to the weapon.

The description given here is intended to illustrate the preferred embodiment of this invention. It is possible to make various changes to the details of the apparatus without departing from this invention. It is intended that all such variations be included within the following claims.

We claim:

1. A safety locking mechanism for a handgun of the revolver type having side plates, each side plate having an internal and external face, a rotatable swing-out type cartridge holding cylinder having a cylinder release mechanism, a trigger having a first position and a second firing position, and an exposed pivotable cartridge striking hammer having a first closed and second cocked position, comprising:

an internal locking means having a first position permitting operation of the hammer and trigger and allowing the cylinder to be opened, and a second position preventing pivotal movement of the hammer and preventing the cylinder from being opened; and a means for engaging with the internal locking means for placing the internal locking means in either the first position or in the second position.

2. The safety locking mechanism of claim 1, wherein the engaging means is external to and removable from the revolver.

3. The safety locking mechanism of claim 1, wherein the internal locking means comprises:

the revolver side plate having a drilled or tapped hole there and further having a counterbore on the internal face of the side plate; and a hammer and cylinder blocking means adapted to fit within the hole on the revolver side plate.

4. The internal locking means of claim 3, wherein the hammer blocking means includes:

a screw having a selected drive means adapted to mate with the threads in the side plate hole;

the set screw drive means adapted to mate with the engaging means; and a blocking means, the blocking means when in its second locked position coming into contact with the hammer when attempting to move the hammer from its first closed position to its second cocked position or when moving the trigger from its first position to its second position, thereby preventing further movement of the hammer and trigger, and the blocking means coming into contact with the cylinder release means preventing further movement of the cylinder release means.

5. The safety locking device of claim 4, wherein the blocking means comprises a flat button affixed concentrically to the end of the set screw.

6. A safety locking mechanism for a handgun of the revolver type having a frame, a rotatable swingout type cartridge holding cylinder attached to the frame, an exposed pivotable cartridge striking hammer attached to the frame that is spring biased toward the cylinder and manually pivotable against the spring bias away from the cylinder preparatory to discharging a cartridge, and a thumbpiece connected to the frame which operates a cylinder opening bar that is movable between a first position facilitating insertion of cartridges into the cylinder and a second position where cartridges are captive within the cylinder, the safety locking mechanism comprising:

an internal locking means that is inserted in the frame of the handgun behind the trigger, wherein the internal locking means is movable between an unlocked position facilitating operation of the cartridge striking hammer and allowing the cylinder opening bar to be movable between the second position and the first position, enabling insertion of cartridges, and a locked position wherein the internal locking means is positioned to directly engage the hammer preventing pivotal movement of the hammer away from the cylinder and wherein the internal locking means is also positioned to directly engage the cylinder opening bar to prevent the cylinder from being swung out for reloading; and a means for engaging with the internal locking means for placing the internal locking means in either the locked or unlocked position.

7. The safety locking mechanism of claim 6, wherein the engaging means is external from the revolver and is removable from the revolver.

8. The safety locking mechanism of claim 6, wherein the internal locking means comprises:

the revolver side plate having a drilled or tapped hole there and further having a counterbore on the internal face of the side plate; and a hammer and cylinder blocking means adapted to fit within the hole on the revolver side plate.

9. The internal locking means of claim 8, wherein the hammer blocking means includes:

a screw having a selected drive means adapted to mate with the threads in the side plate hole;

the set screw drive means adapted to mate with the engaging means; and a blocking means, the blocking means when in its second locked position coming into contact with the hammer when attempting to move the hammer from its first closed position to its second cocked position or when moving the trigger from its first position to its second position, thereby preventing further movement of the hammer and trigger, and the blocking means coming into contact with the cylinder release means preventing further movement of the cylinder release means.

10. The safety locking device of claim 9, wherein the blocking means comprises a flat button affixed concentrically to the end of the set screw.

* * * * *